US006616225B2

(12) United States Patent
Graff

(10) Patent No.: US 6,616,225 B2
(45) Date of Patent: Sep. 9, 2003

(54) TOWEL ADAPTED TO REMAIN ON A CHAIR METHOD AND APPARATUS

(76) Inventor: Emma Graff, 2141 B Cardinal La., Oak, WA (US) 98277

( * ) Notice: Subject to any disclaimer, the term of this patent is extended or adjusted under 35 U.S.C. 154(b) by 0 days.

(21) Appl. No.: 09/812,863

(22) Filed: Mar. 19, 2001

(65) Prior Publication Data

US 2001/0035672 A1 Nov. 1, 2001

Related U.S. Application Data

(60) Provisional application No. 60/190,240, filed on Mar. 17, 2000.

(51) Int. Cl.[7] ..... A47C 27/00
(52) U.S. Cl. ..... 297/229
(58) Field of Search ..... 297/229, 219.1, 297/228.11, 183.1, 183.5, 118, 129

(56) References Cited

U.S. PATENT DOCUMENTS 4,190,918 A * 3/1980 Harvell
4,273,380 A 6/1981 Sivestri
4,536,028 A 8/1985 Jones et al.
4,553,785 A 11/1985 Duke, Jr. et al.
4,656,670 A 4/1987 Schluter
4,671,568 A 6/1987 Greer
4,676,376 A 6/1987 Keiswetter
4,725,094 A 2/1988 Greer
4,793,012 A 12/1988 LaPorte
4,844,540 A 7/1989 Pegram
4,877,288 A 10/1989 Lee
4,892,353 A 1/1990 Goddard
5,150,945 A 9/1992 Aupperlee et al.
5,618,082 A 4/1997 Jachmich
5,620,229 A 4/1997 Ledford
5,709,431 A 1/1998 Horn
6,135,635 A * 10/2000 Miller et al.
6,149,234 A * 11/2000 Daniels

* cited by examiner

*Primary Examiner*—Milton Nelson, Jr.
(74) *Attorney, Agent, or Firm*—Robert B. Hughes; Hughes Law Firm, PLLC

(57) ABSTRACT

A towel that is adapted to be mounted to a chair where the pouch region of the towel functions to hold the main body portion of the towel in a mobile configuration, and the pouch region further supports the head region of the towel onto the upright portion of the chair. The towel comprises a handle attached to the perimeter opening of the pouch portion and the handle is adapted to carry the towel.

12 Claims, 5 Drawing Sheets

TOWEL ADAPTED TO REMAIN ON A CHAIR METHOD AND APPARATUS

This application claims the benefit of provisional application No. 60/190,240, filed Mar. 17, 2000.

FIELD OF THE INVENTION

The invention relates to beach towels that are adapted to cover a lawn chair and more particularly towels that have a hood portion which cover the head portion of a lawn chair where the body of the towel can be stored in the hood portion and straps are provided to carry the towel.

BACKGROUND

Towels have been used to cover lawn chairs so that sunbathers do not have to come in direct contact with the upper surface of a lawn chair. Often times conventional towels are used to cover lawn chairs for comfort and sanitation reasons. When a sunbather is lounging in a lawn chair, generally the head portion of the lawn chair is in a partial vertical position (20 to 70 degrees). One of the common problems with conventional towels is that the head portion of the towel will not remain positioned on the head portion of the lawn chair. Therefore the head portion of a conventional towel continuously falls exposing the upper surface of the lawn chair to the individual.

BACKGROUND ART

The prior art devices has attempted to provide lawn chair covers that have a hood portion which is adapted to be positioned on the head portion of a lawn chair. However, the prior art has failed to illustrate a simplified design where the lawn chair cover is made from a unitary length of material. Further, many of the prior art devices have a portion that is rigid or a portion that cannot go through a washing machine. This prevents prior art lounge chair covers from being machine washable.

A search of the patent literature has a number of patents directed toward the problems of covering a lounge chair, these being the following:

U.S. Pat. No. 4,273,380 Silvestri, shows a beach towel/chair cover was along gates strip of towel with a pocket on one end to hold the towel portion therein. As seen in FIG. 2 the pocket 14 can hold the towel. FIG. 3 is a cross-sectional view indicating that there are to compartments in the towel bag 10. FIGS. 4 through 7 illustrate a method of manufacturing the towel 10. The staging 32 creates an upper portion hood that is adapted to fit on a lawn chair (see FIG. 1)

U.S. Pat. No. 4,536,028 Jones et al., shows a fitted sheet for a lounge chairs where both ends of the chair are covered by ends 42 and 44. FIG. 2 is almost an optical illusion because it is a bottom and rearward perspective view of the underside of the chair showing the pockets 50 and 52 over the end portions of the chair. FIG. 1 shows a top portion of the chair cover to with a top panel 40 of the fitted sheet 10.

U.S. Pat. No. 4,553,785 Duke, Jr. et al., shows a removable cover for a lounge chair that has a pillow 23 positioned under straps 22.

U.S. Pat. No. 4,656,670 Schluter, discloses a combination beach towel and robe. As seen in FIG. 4, the female places her head through slot 20 and cord 36 ties around her waist. As shown in FIG. 5, the flap 40 which is peripherally sewn to the edge of the fabric piece 14, is mounted on the chair 48

U.S. Pat. No. 4,671,568 Greer, shows a mattress with elastic border that has several loops to prevent slippage.

U.S. Pat. No. 4,676,376 Keiswetter, shows a temporary cover for a car seat where there is a cap 20 mounted on the seat 12. The seat cover 10 is constructed from two different thermoplastic materials so the inner side it adheres to the seat and the outward side is relatively nonadhesive.

U.S. Pat. No. 4,725,094 Greer, shows a covering for a lawn chair where at the upper end portion 48 there is a rear surface layer 56 that makes a hood which is adapted to fit over the upper portion of the chair. There are two lateral side pockets 64 and 66 which can hold personal belongings.

U.S. Pat. No. 4,793,012 LaPorte, shows a beach mat that can fold up in a desirable manner.

U.S. Pat. No. 4,844,540 Pegram, has a beach towel and chair cover which has elastic straps on either ends to help keep the towel on the beach chair as seen in FIGS. 10*a*-11. The straps 12 are adapted to be positioned around corners of the chair 20.

U.S. Pat. No. 4,877,233 Lee, discloses a lounge chair cover where as seen in FIG. 3, there is a vertical cross-sectional view showing a pillow pocket 79 and a rear pocket 50 mounted over the head end border 40.

U.S. Pat. No. 4,892,353 Goddard, shows a lawn chair cover where FIG. 2 is a cross-sectional vertical view of the upper hood where flap 33 provides for a pocket portion.

U.S. Pat. No. 5,150,945 Aupperlee et al., shows a vehicle child seat cover where there is a fitting sleeve 5 that fits on the back of the seat portion 2.

U.S. Pat. No. 5,618,082 Jachmich, shows a one-piece seat cover that has a second opening 22 which serves as a hood to cover the upper portion of the seat R.

U.S. Pat. No. 5,620,229 Ledford, shows a lounge seat cover where in FIG. 5 there is a cross-sectional view showing the hood 2 over the head portion of the lawn chair. The pocket 34 is made from a netting material. In this patent there are lock clamps 58 and 62 attached to straps 56 and 60 that are apparently used to keep the lounge chair in a folded position to be carried.

U.S. Pat. No. 5,709,431 Horn shows a car vehicle seat that has a hood portion shown in FIGS. 1 and 2 where the external portion that is exposed to a driver is made of relatively low coefficient of friction material while the inner portion that is exposed to the seat is made from a higher coefficient of friction material (stickier).

The prior art fails to show a system with less structure and more functionality that is economical to produce and provide the options for at least one attachment strap having attachment ends connected to lateral regions of the hood portion and the attachment strap is adapted to carry the towel. The prior art further fails to disclose a towel that comprises a pouch portion and the head region of the towel with at least one strap adapted to carry the towel in the mobile configuration (the body of the towel folded into the chamber region of the pouch portion) and the same pouch is used for keeping the head portion of the towel attached to the upright portion of the chair.

SUMMARY OF THE INVENTION

A towel that is adapted to be mounted on a chair. The chair having an upright portion was corner regions, a front region and back region. The towel has a lengthwise body that comprises a main body which is the portion of the towel extending longitudinally from the pouch opening. The lengthwise body has a first surface and a second surface, a head region and a foot region.

A pouch portion is located in the head region of the lengthwise body and the couch portion has a front section and a back section. The front and back sections are connected at the extreme lateral edges and defined a chamber region. The pouch further having first and second lateral locations that are defined as opposite lateral sides of the longitudinal center line of the touch portion. The pouch portion further having a perimeter edge located on the back section where this edge is adapted to engage the back region of the chair. The first attachment strap having first and second ends attached respectively to the first and second lateral portions.

The chamber region of the pouch is adapted to fit around the upright portion of the chair where the second surface engages the chair and the perimeter edge is adapted to support fully engage the back region of the chair to keep the pouch portion remaining on the upright portion of the chair. The lengthwise body is adapted to successively folded and be positioned in the chamber region of the pouch portion to place the towel in a mobile configuration where the first attachment strap can be used to carry the towel. The successive folding includes any manner of folding the towel to reduce its net lengthwise length.

The invention further includes first and second laterally extending chambers adapted to house a drawstring. The first laterally extending chamber is located on the front portion of the pouch region. The perimeter edge of the pouch portion defines a second laterally extending chamber that is at a proximate longitudinal location to the first laterally extending chamber. The drawstring extends to the chambers to restrict the perimeter opening of the pouch region.

DETAILED DESCRIPTION OF THE PREFERRED EMBODIMENT

Throughout this description reference is made to top and bottom, front and rear. The device of the present invention can, and will in practice, be in numerous positions and orientations. These orientation terms, such as top and bottom, are obviously used for aiding the description and are not meant to limit the invention to any specific orientation.

Figure 1:
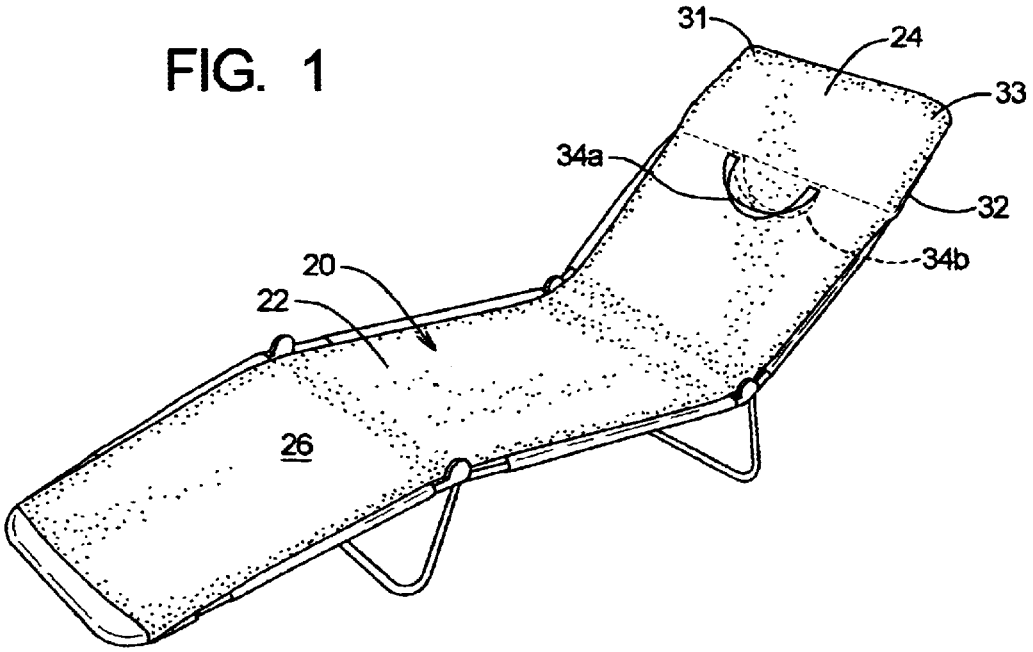
FIG. 1 is a perspective view of the apparatus of the present invention positioned on a foldable lawn chair where the hood portion is positioned on the head portion of the lawn chair.
Figure 2:
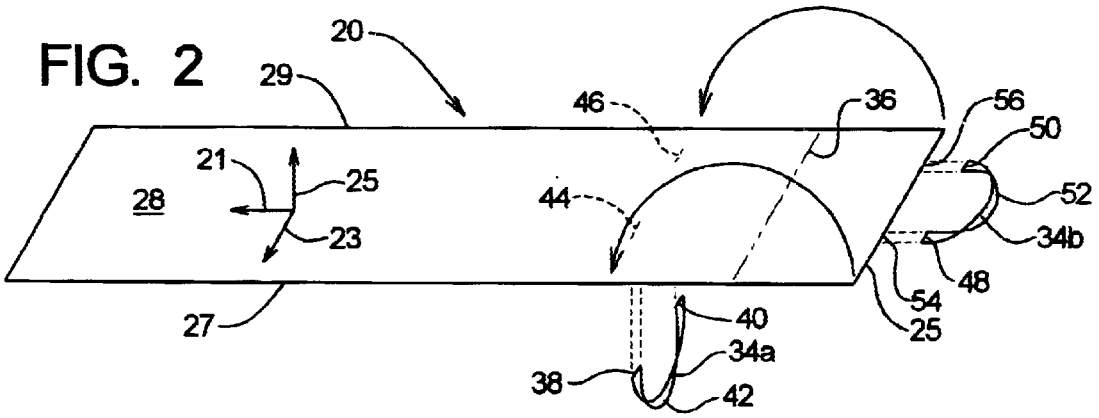
FIG. 2 shows a method of making the modified towel.

As seen in FIG. 2, a coordinate system is defined with relation to the towel 20 where axis 21 defines a longitudinal direction and the arrow of axis 21 indicates a downward direction and the opposite direction is referred to as an upward direction. Axis 23 defines a lateral direction and axis 25 defines a vertical direction.

The modified towel 20 comprises a body portion 22 and a head portion 24. The towel 20 further has a first side 26 and a second side 28 and a first perimeter edge 27 and a second perimeter edge 29.

The head portion 24 comprises a hood 32 and straps 34. The hood 32 has a perimeter edge 25, a first corner section 31 and a second corner section 33.

In general the towel 20 is made from common moisture absorbing fabric that is common for ordinary towels.

As seen in FIG. 2, the method of manufacturing the towel 20 is accomplished by first retrieving a extended longitudinal length of towel fabric material in the order of 6 to 12 feet and an appropriate lateral width that is proximate to the average width of a lawn chair. At the head portion 24 of the towel 20, the towel fabric is folded downwardly about a lateral axis indicated at the 36. Next the straps 34*a* and 34*b* are sewn or otherwise attached to the hood portion 24.

The strap 34*a* has a first end 38 a second end 40 and a central portion 42. The first end 38 is sewn or otherwise attached at the first connection portion 44 which is located on the second side 23 of the towel 20. Likewise, the second end 40 is attached to a second connection portion 46 that is also located on the second side 23 of the towel 20. In a similar manner strap 34*b* is attached to the perimeter edge 25 of the hood portion 22.

Strap 34*b* has a first end 48, a second end 50 and a central portion 52. The first end 48 is attached to a first connection portion 54 which is located near the perimeter edge 25. The second end 50 is also attached near the perimeter edge 25 in a laterally opposite direction at the second connection portion 56. The method of fastening the straps 34 can be done by sewing them to the fabric of the towel 20. Of course, the straps 34 could be glued to the connection portion's 44, 46, 54 and 56 with a suitable fabric adhesive; however, fastening the straps 34 by means of sewing is particularly advantageous because of the durability of the stitches and it allows flexibility in the fabric that is desirable when someone lies back on the front strap 34*a* which will further be discussed herein.

Figure 3:
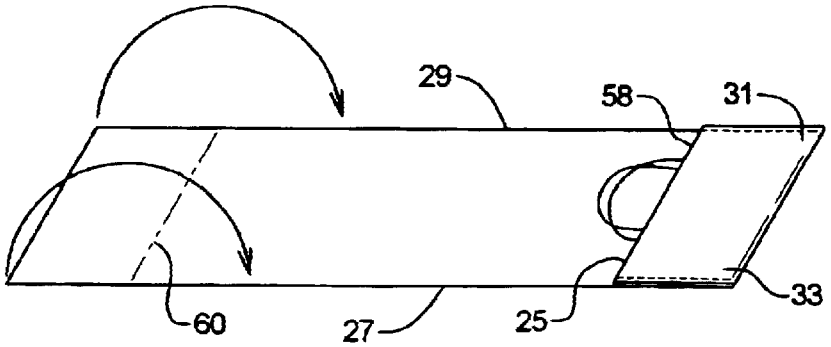
FIGS. 3–6 progressively show the method of folding the towel to a mobile configuration.

As seen in FIG. 3, the overlapping portions of the first and second perimeter edges 27 and 29 in the head portion 24 are sewn together to create a pouch or chamber 58.

Figure 4:
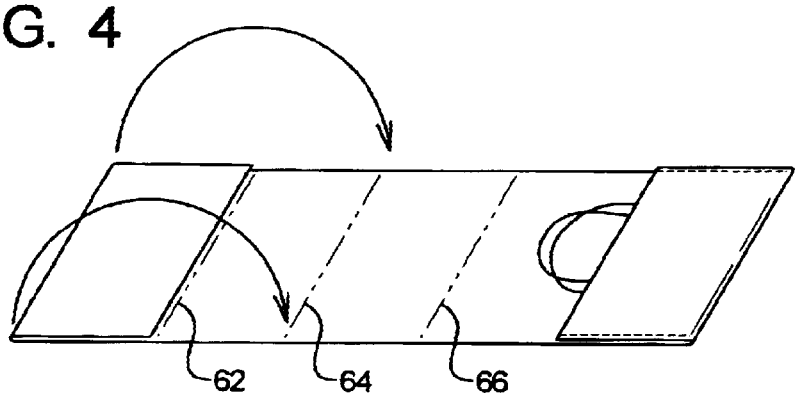
Figure 5:
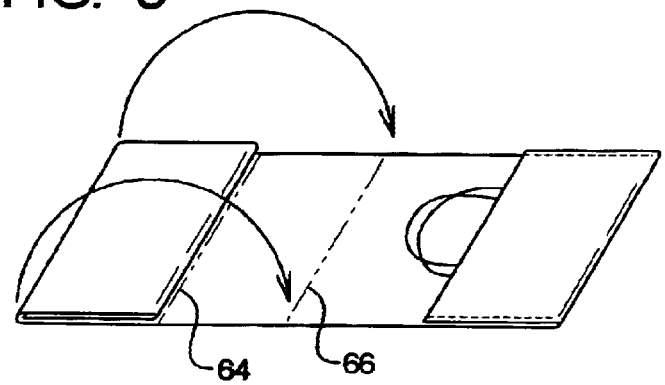
Figure 6:
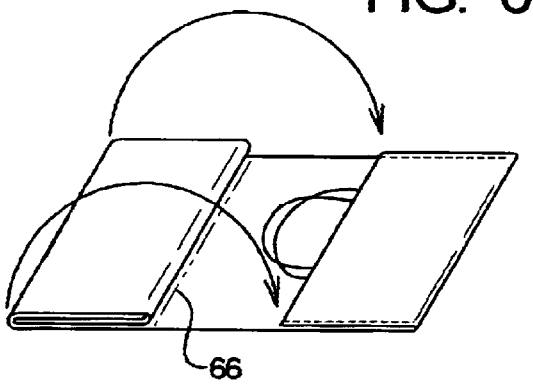
Figure 7:
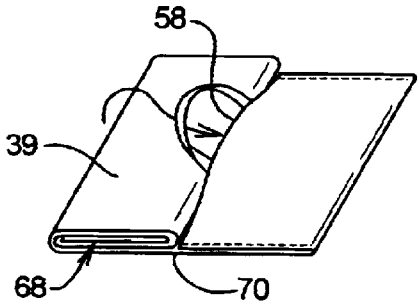
FIG. 7 shows a final step and tacking the folded body portion of the towel into the pouch.
Figure 8:
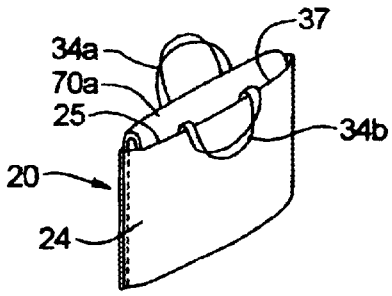
FIG. 8 is an oblique view of the towel and a mobile configuration.

FIGS. 3–7 illustrate the method of storing the towel 20 to a mobile configuration as seen in FIG. 8. In general, the pouch 58 not only is useful to holding the towel on the head portion of a lawn chair, but further, can be used to store the body portion 22 of the towel 20. As seen in FIG. 3, the lower portion of the body 22 is folded about a lateral crease 60. FIGS. 4, 5 and 6 illustrate successive folds about creases 62, 64 and 66 respectively. The final step is shown in FIG. 7 where the folded body section 68 has a final folded about a longitudinal crease 70 and is finally tucked into the pouch 58 to a position that is shown in FIG. 8. Now the towel 20 can be carried by grasping the central portions 42 and 52 of the straps 36*a* and 36*b*. The maximum volume of the pouch 58 is greater than the volume of the folded towel portion 68 which allows other items such as suntan lotion, bathing suits, etc. to be carried along with the towel 20. The main body portion 39 is defined as the portion of the towel extending from the crease 70. This portion can be folded and topped into the perimeter opening 37 of the pouch region 24. The perimeter opening 37 comprises the edge 25 and creased region 70*a*.

Figure 9:
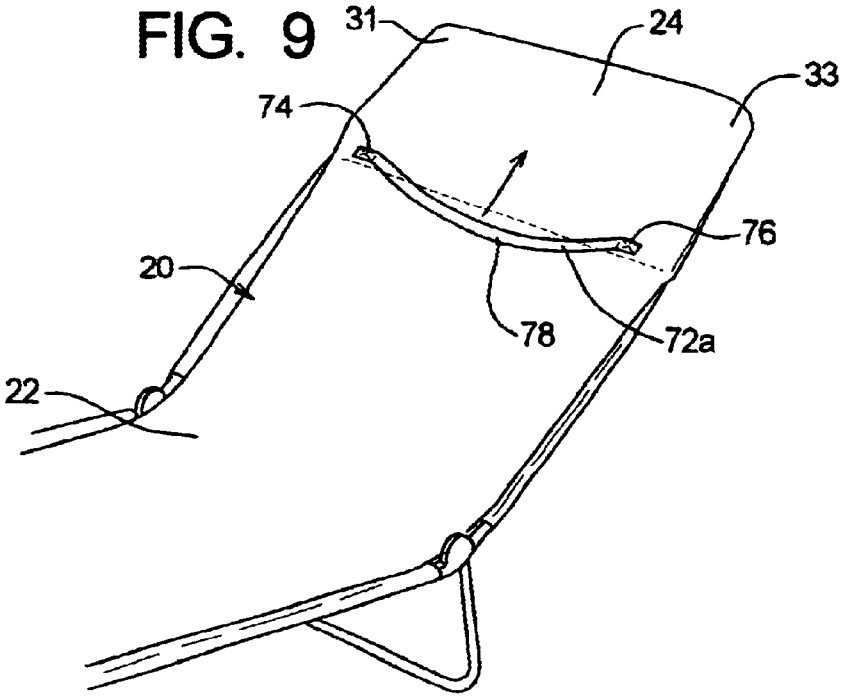
FIG. 9 is an oblique view of a second embodiment of the apparatus of the present invention where the straps are longer in length and attached at a more lateral location on the hood portion of the towel.
Figure 10:
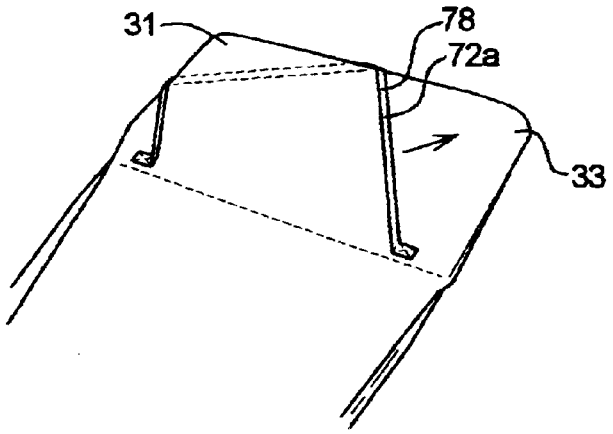
FIG. 10 is an isometric view of the hood portion of the second embodiment progressively repositioning the front strap to mounted around to the rear part of the head portion of the lawn chair.
Figure 11:
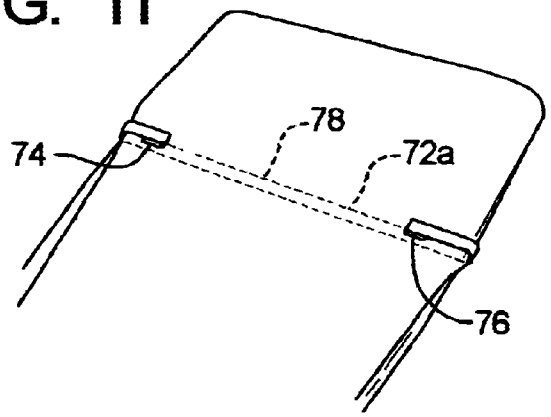
FIG. 11 is an isometric view of the second embodiment where the front straps is positioned to wraparound the rear part of the head portion of the lawn chair.

FIGS. 9–11 illustrate a second embodiment of the present invention. The main difference in this embodiment is that the straps 72 are made of an elastic material and are connected to the towel at a more lateral position. The longer length of the straps and the elasticity 72 allow the front strap 72*a* to wrap around the rear parts of the head portion of a lawn chair.

As seen in FIG. 9, the strap 72*a* has a first end portion 74, a second end portion 76 and a central portion 78. The individual that is going to lie down on the towel may not want the strap 78*a* in direct contact with their back. Further, if the pouch portion of the towel is larger then the head portion of the chair then the strap 72*a* can assist and holding the hood portion 24 of the towel 20 on the chair. As seen in FIG. 10, the central portion 78 of the front strap 72*a* is positioned over the first corner 31 of the hood portion 24. The individual continues to position the strap over the second corner 33. Finally, the towel is in a position as shown in FIG. 11 where the hood portion 24 is secured to the head portion of the lawn chair. It should be noted that a second rear handle is not shown in FIGS. 9–11. The handle is attached to the perimeter rim 25 of the hood portion 24 (not shown). This handle would have the proximate attachment locations in the longitudinal and lateral directions as the first handle 72*a*. Likewise this handle has the primary purpose of carrying the towel 20 when it is in a mobile configuration (see FIG. 8).

The second embodiment as seen in FIGS. 9–11 has an additional advantage of allowing the individual to carry the towel 20 on their shoulder when it is in a mobile configuration (see FIG. 8 for example of mobile configuration of first embodiment).

Figure 12:
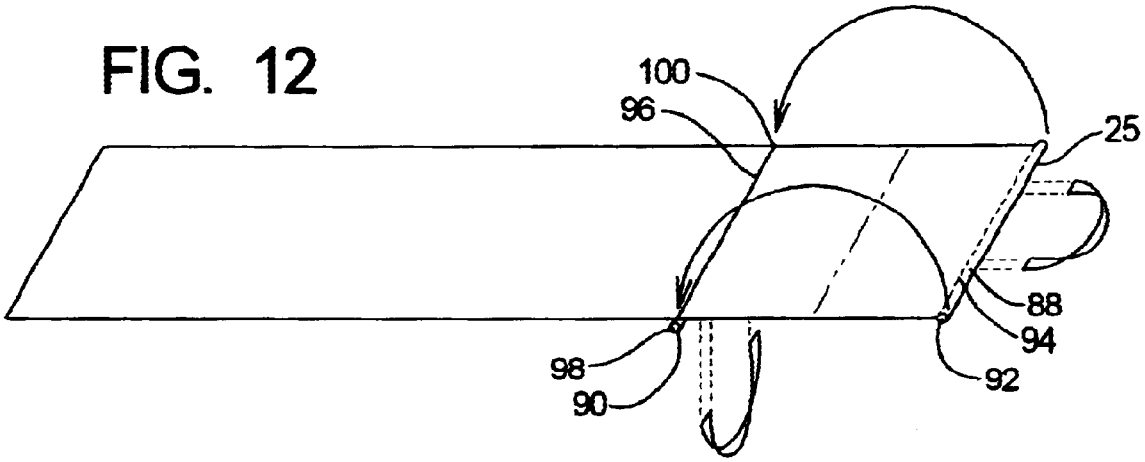
FIG. 12 shows a method of making the third embodiment of the modified towel.
Figure 13:
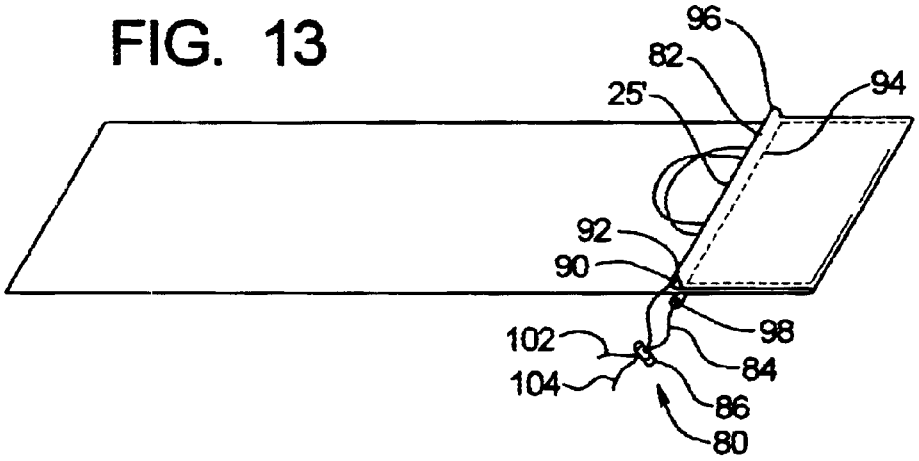
FIG. 13 is an isometric view of the third embodiment.
Figure 14:
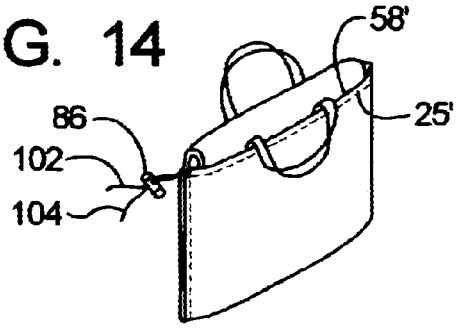
FIG. 14 an isometric view of the third embodiment in a mobile configuration.

A third embodiment of the present invention is shown in FIGS. 12–14. This embodiment utilizes a drawstring assembly 80 that comprises a loop portion 82, a drawstring 84 and a locking member 86. The loop portion 82 comprises a front conduit portion 88 and a rear conduit portion 90. The front conduit portion 88 has an opening 92 and is stitched along line 94 on the perimeter edge 25'. The central conduits difference portion 88 extends around the backside of the body of the towel at point 96 and is in communication with the rear loop portion 90.

As in FIG. 12, the rear loop portion 90 can be made from creating a crease in the lateral direction that is approximately one to two inches of longitudinally towel length sewn together at lateral stitch line 96 to create rear conduit 90 of the loop portion 82. The rear conduit 90 further has an opening or laterally extending chamber 98. The drawstring 84 extends through the opening 92 and extends through the front portion 88. The drawstring 84 further extends into the rear conduit portion 90 at point 100 and extends therethrough to opening 98. Then the two string ends 102 and 104 extends through the locking mechanism 86. The locking mechanism 86 can be the common spring activated types that allow passage of the string members 102 and 204 of the spring-loaded internal chamber is depressed.

As seen in FIG. 14, the third embodiment is in a mobile configuration. The hood portion can be tightened down by pulling on string ends 102 and 104 with respect to the locking member 86. This bundles the perimeter edge 25' into a slightly tighter configuration which helps prevent items from falling out from the pouch portion or chamber 58'.

Figure 15:
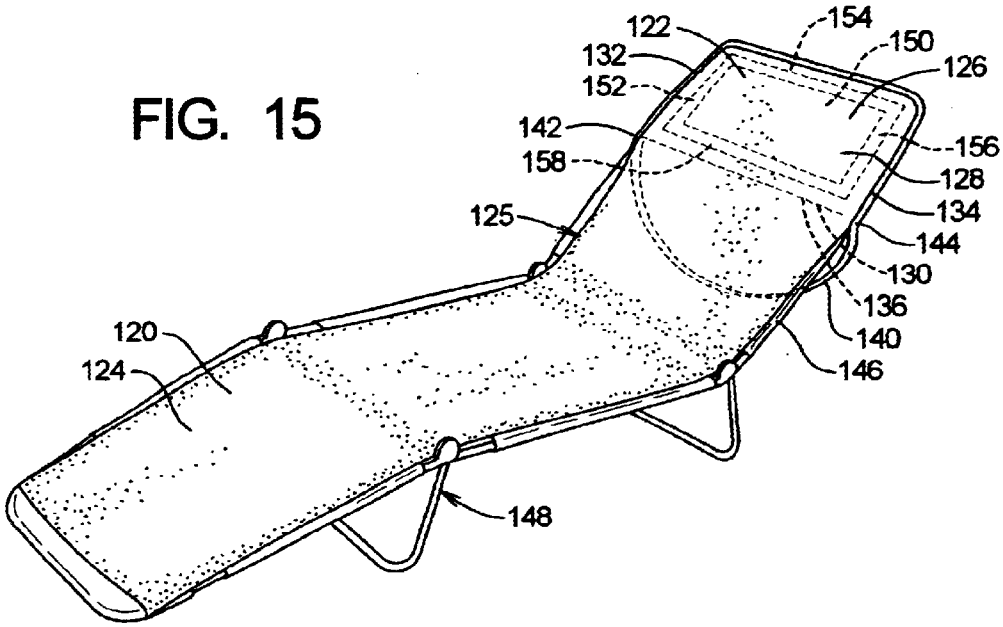
FIG. 15 shows an isometric view of a fourth embodiment of the towel on a lawn chair where a single strap is employed and an interior pocket is shown.

FIG. 15 shows a fourth embodiment of the present invention the where the towel 120 comprises the head portion 122 and a main body 124. It should be noted that the main body 124 in all the embodiments is defined as the region extending longitudinally from the edge 136 of the pouch portion 126.

Located in the head portion 122 is the pouch portion 126 that comprises a first section of material 128 and a second section of material 130 where the extreme lateral first and second locations 132 and 134 are sewn together to create a chamber region therein between. The pouch portion further has a perimeter edge 136. The lengthwise body 125$_{[MH1]}$ consists of the main body 124 and the first section of material 128.

Now discussing the modifications to the fourth embodiment, the first addition is a single attachment strap 140 that has first and second attachment ends 142 and 144 that are attached to the extreme lateral locations of the lengthwise body at a proximate lateral locations to the perimeter edge 136. As shown in FIG. 15, the strap 140 can extend to the rearward portion of the upright portion 146 of the lawn chair 148. Of course the towel is adapted to fit on other chairs having an upright portion 146. The upright portion need not be vertical, but would more commonly have a slight decline angle to support the back of a user.

Figure 16:
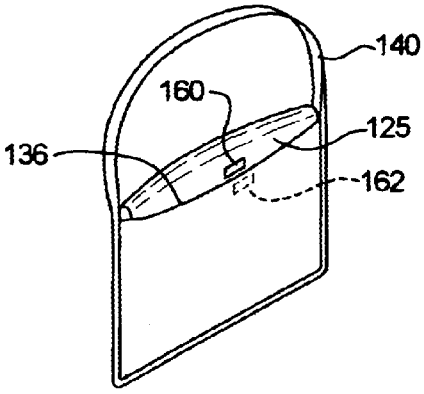
FIG. 16 is an isometric view of the towel in a mobile configuration where an attachment apparatus such as Velcro™ male and female receiving patches are employed to help confine the contents in the chamber region.

The second addition to the fourth embodiment is employing an internal pouch 150. In a preferred form, the internal pouch is attached to the first section of material 128. The material of the pouch 150 itself can function as a padded support for the head of the user, alternately the pouch 150 can store a pillow to provide padded support. The internal pouch is preferably sewn along the perimeter edges 152,154 and 156. Thus an opening to the chamber the pouch is preferably located at laterally extending edge 158. When in a mobile position as shown in FIG. 16, the internal pouch can function as a storage pouch to store accessories such as sunglasses, suntan oil etc. The advantage of having the pouch sewn to the first section 128 is when the main body 124 is folded and stored within the chamber region, the main body covers the opening of the internal pouch and hence helps secure the contents therein. The pouch could alternately be located in a similar configuration on section 130 and hence be more accessible when the mobile configuration as shown in FIG. 16.

A third edition to the fourth embodiment is shown in FIG. 16 where male and female Velcro™ patches are employed. The female Velcro patch 160 is located on the upper portion of the lengthwise body 125 and is the portion of the Velcro pair that is softer to touch and has superior tactile qualities. The male patch 162 is attached to the interior portion of the perimeter edge 136 and is adapted to engage the female patch 160 to help keep the contents of the chamber positioned therein (including the main body 124 of the towel 120). In the broader scope, Velcro™ patches 160 and 162 can extend to any lateral width. It is desirable to have the female patch on the upper surface of the lengthwise body 125 because this will engage the end-user in the operative position as shown in FIG. 15.

Figure 17:
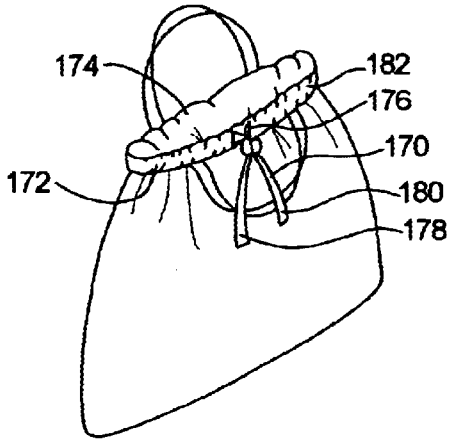
FIG. 17 is an isometric view of the towel in a mobile configuration where the drawstring is employed and constricts the opening of the chamber of the head region.

FIG. 17 shows the present invention in a mobile configuration where the drawstring 170 extends to a first laterally extending chamber 172 and a second laterally extending chamber 174 where the first chamber 172 has an opening 176 adapted to allow the first and second end portion 178 and 180 extend therethrough.

As shown in this figure the perimeter of the pouch region 182 is constructed to help keep the contents contained therein. Of course this drawstring embodiment is applicable to the single strap embodiment shown in FIG. 15 as well as the other embodiments. Further, the combination of elements contained herein the specification can be combined to create a number of combination embodiments as part of the broader scope of the present invention.

While the invention is susceptible of various modifications and alternative forms, specific embodiments thereof have been shown by way of example in the drawings and will herein be described in detail. It should be understood, however, that it is not intended to limit the invention to the particular forms disclosed, but, on the contrary, the intention is to cover all modifications, equivalents and alternatives falling within the spirit and scope of the invention as expressed in the appended claims.

I claim:

1. A towel/carrier combination that is adapted to provide a cover for a chair of predetermined length and width dimensions, to provide attachment support for the cover at a head end of the chair, and to provide for storage and transportation for the towel/carrier combination, said combination comprising:

a) a main towel section which is foldable and is made of a towel fabric, has a head end portion and a foot end portion, and has sufficiently great length and width dimensions to cover at least a substantial portion of a chair;

b) a pouch defining section which has upper, lower, and side edge portions with the upper and side edge portions being connected to an upper edge portion and side edge portions of the head end portion of the main towel section, to define with the head end portion of the main towel section a pouch chamber, which has a pouch opening defined by the lower edge portion of the pouch defining section and by an adjacent portion of the main towel section, with the pouch opening facing toward the foot end portion of the main towel section, and the pouch opening having a sufficient width dimension to fit over the head end of the chair to position and support the main towel section over the chair;

c) said pouch defining section also being configured and dimensioned to have the pouch opening sufficiently large to receive the main towel section in a folded configuration, and have a storage volume of the pouch chamber sufficiently large to receive the main towel section in said folded configuration, so that the main towel section can be folded into the folded configuration and stored in the pouch chamber to combine the main towel section and the pouch defining portion into a storage and carrying configuration, where the lower edge portion of the pouch defining section is adjacent to an exposed folded edge portion of the main towel section, with the lower edge portion of the pouch defining section and the adjacent exposed folded edge portion providing an open access region of the combined storage and carrying configuration, and the upper and side edge portions of the pouch defining section are closed containing edge portions of the combined storage and carrying configuration;

d) a carrying handle attached to said towel/carrying combination at the open access region of said storage and carrying configuration, whereby the towel/carrier combination can be arranged to function as a towel cover for a chair by positioning the pouch defining section with the adjacent portion of the main towel section over a head portion of the chair, and with the main towel section covering at least a substantial portion of the chair, and then the main towel section and the pouch defining section can be re-configured by folding the main towel section into a stowed configuration and inserting the main towel section in the stowed configuration through the pouch opening into the pouch chamber to form the towel carrier combination, and then transporting the towel/carrier combination by grasping the carrying handle and then carrying the towel/carrier combination to another location.

2. The combination as recited in claim 1, wherein said main towel section and said pouch defining section are both made from the same towel fabric.

3. The combination as recited in claim 2, where the main towel section and the pouch defining section are made from an integral piece of towel fabric which is folded on itself, and has adjoining edge portions of the towel fabric joined together to form the pouch defining section and the main towel section.

4. The combination as recited in claim 1, wherein said handle is arranged with two connecting end portions which are fixedly connected at connecting locations to at least the lower edge portion of the pouch defining section.

5. The combination as recited in claim 4, wherein there is a second handle which is connected to the main towel section at a location at or adjacent to the exposed folded edge portion of the main towel section so that the handle attached to the pouch defining section and the second handle in the storage and carrying configuration are adjacent to one another.

6. The combination as recited in claim 1 wherein said handle comprises a flexible handle member which extends into a perimeter channel formed in an adjacent portion of the lower edge portion of the pouch defining section, whereby tension on a string causes the lower edge portion of the pouch defining section to contract.

7. A method of providing and utilizing a towel/carrier combination to provide a cover for a chair of predetermined length and width dimensions, to provide attachment support for the cover at a head end of the chair, and to provide for storage and transportation for the towel/carrier combination, said method comprising:

a) providing a main towel section which is foldable and made of a towel fabric, has a head end portion and a foot end portion, and has sufficiently great length and width dimensions to cover at least a substantial portion of a chair;

b) providing a pouch defining section which has upper, lower, and side edge portions with the upper and side edge portions being connected to an upper edge portion and side edge portions of the head end portion of the main towel section, to define with the head end portion of the main towel section a pouch chamber, which has a pouch opening defined by the lower edge portion of the pouch defining section and by an adjacent portion of the main towel section, with the pouch opening facing toward the foot end portion of the main towel section, and providing the pouch opening with a sufficient width dimension to fit over the head end of the chair to position and support the main towel section over the chair;

c) configuring and dimensioning said pouch defining section to have the pouch opening sufficiently large to receive the main towel section in a folded configuration, and have a storage volume of the pouch chamber sufficiently large to receive the main towel section in said folded configuration;

d) folding the main towel section into the folded configuration and storing the main towel section in the folded configuration in the pouch chamber to combine the main towel section and the pouch defining section into a storage and carrying configuration, where the lower edge portion of the pouch defining section is adjacent to an exposed folded edge portion of the main towel section, with the lower edge portion of the pouch defining section and the adjacent exposed folded edge portion providing an open access region of the combined storage and carrying configuration, and the upper and side edge portions of the pouch defining section are closed containing edge portions of the combined storage and carrying configuration;

e) providing a carrying handle attached to said towel/carrier combination at the open access region of said storage and carrying configuration, and then transporting the towel/carrier combination by grasping the carrying handle and then carrying the towel/carrier combination to another location.

8. The method as recited in claim 7, further comprising providing said main towel section and said pouch defining section from the same towel fabric.

9. The method as recited in claim 8, further comprising providing the main towel section and the pouch defining section as made from an integral piece of towel fabric which is folded on itself, with adjoining edge portions of the towel fabric joined together to form the pouch defining section and the main towel section.

10. The method as recited in claim 7, further comprising providing said handle with two connecting end portions which are fixedly connected at connecting locations to at least the lower edge portion of the pouch defining section.

11. The method as recited in claim 10, further comprising providing a second handle which is connected to the main towel section at a location at or adjacent to the exposed folded edge portion of the main towel section so that the handle portion attached to the pouch defining section and the second handle in the storage and carrying configuration adjacent to one another.

12. The method as recited in claim 7, further comprising providing said handle, as a flexible handle member which extends into a perimeter channel formed in an adjacent portion of the lower edge portion of the pouch defining section, whereby tension on a string causes the lower edge portion of the pouch defining section to contract.

* * * * *